US009857039B2

(12) United States Patent
Jagt et al.

(10) Patent No.: US 9,857,039 B2
(45) Date of Patent: Jan. 2, 2018

(54) LIGHTING DEVICE COMPRISING A RING-SHAPED LIGHT TRANSMITTING ELEMENT

(71) Applicant: PHILIPS LIGHTING HOLDING B.V., Eindhoven (NL)

(72) Inventors: Hendrik Johannes Boudewijn Jagt, Eersel (NL); Christian Kleijnen, Ittervoort (NL); Wouter Dekkers, Roosendaal (NL); Olexandr Valentynovych Vdovin, Maarheeze (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/908,841

(22) PCT Filed: Mar. 5, 2015

(86) PCT No.: PCT/EP2015/054646
§ 371 (c)(1),
(2) Date: Jan. 29, 2016

(87) PCT Pub. No.: WO2015/139968
PCT Pub. Date: Sep. 24, 2015

(65) Prior Publication Data

US 2016/0377248 A1 Dec. 29, 2016

(30) Foreign Application Priority Data

Mar. 18, 2014 (EP) ..... 14160398

(51) Int. Cl.
*F21V 9/16* (2006.01)
*F21S 10/04* (2006.01)
(Continued)

(52) U.S. Cl.
CPC ..... *F21S 10/043* (2013.01); *F21S 6/001* (2013.01); *F21S 10/005* (2013.01); *F21V 3/04* (2013.01);
(Continued)

(58) Field of Classification Search
CPC ..... F21S 10/043; F21S 6/001; F21V 29/70; F21V 3/04; F21V 7/22; F21V 9/16;
(Continued)

(56) References Cited

U.S. PATENT DOCUMENTS

2007/0177393 A1* 8/2007 Hirata ..... F21S 6/001 362/392
2008/0121900 A1 5/2008 Wu et al.
(Continued)

FOREIGN PATENT DOCUMENTS

CN 102261568 A 11/2011
CN 202405308 U 8/2012
(Continued)

OTHER PUBLICATIONS

Glow Company, http://www.glow.co.uk/virtual-flame-candles.html, Dec. 2013 (2 PAGES).
(Continued)

*Primary Examiner* — Elmito Breval
*Assistant Examiner* — Glenn Zimmerman

(57) ABSTRACT

A lighting device is disclosed, which comprises a light transmitting element extending along a perimeter such that a hollow is defined by the light transmitting element. The light transmitting element comprises a light in-coupling surface adapted to couple light emitted by at least one light emitting element into the light transmitting element, and a light out-coupling surface adapted to couple light out of the light transmitting element. The lighting device is combined with a light reflecting envelope arranged to enclose the
(Continued)

lighting device such that light emitted from the light out-coupling surface is reflected at an inner surface of the envelope. Thereby a reflected image may be produced, having an appearance resembling a candle flame.

15 Claims, 4 Drawing Sheets

(51) Int. Cl.

| | |
|---|---|
| ***F21S 10/00*** | (2006.01) |
| ***F21V 29/70*** | (2015.01) |
| ***F21S 6/00*** | (2006.01) |
| ***F21V 3/04*** | (2006.01) |
| ***F21V 7/22*** | (2006.01) |
| ***F21V 19/00*** | (2006.01) |
| *F21Y 103/33* | (2016.01) |
| *F21Y 113/10* | (2016.01) |
| *F21Y 115/10* | (2016.01) |

(52) U.S. Cl.
CPC ..... *F21V 7/22* (2013.01); *F21V 9/16* (2013.01); *F21V 19/003* (2013.01); *F21V 29/70* (2015.01); *F21Y 2103/33* (2016.08); *F21Y 2113/10* (2016.08); *F21Y 2115/10* (2016.08)

(58) Field of Classification Search
CPC F21V 19/003; F21Y 2113/10; F21Y 2115/10; F21Y 2103/33
USPC ..... 362/84, 227, 229, 230, 458, 810, 293
See application file for complete search history.

(56) References Cited

U.S. PATENT DOCUMENTS

| | | | | |
|---|---|---|---|---|
| 2009/0046454 | A1 | 2/2009 | Bertram et al. | |
| 2010/0097811 | A1* | 4/2010 | Betsuda | F21K 9/135 362/362 |
| 2010/0230708 | A1 | 9/2010 | Tran | |
| 2011/0116252 | A1* | 5/2011 | Agatani | F21K 9/00 362/84 |
| 2012/0044669 | A1* | 2/2012 | Ogata | F21K 9/90 362/97.3 |
| 2012/0099332 | A1* | 4/2012 | Weaver | F21S 8/02 362/373 |
| 2012/0169235 | A1* | 7/2012 | Dassanayake | F21V 3/049 315/113 |
| 2012/0262902 | A1* | 10/2012 | Pickard | F21S 8/026 362/84 |
| 2013/0044480 | A1* | 2/2013 | Sato | F21S 8/061 362/235 |
| 2013/0155719 | A1 | 6/2013 | Brott et al. | |
| 2013/0170178 | A1 | 7/2013 | Yoo et al. | |
| 2014/0204606 | A1* | 7/2014 | Smits | G02B 6/0008 362/558 |
| 2014/0362586 | A1* | 12/2014 | Wu | F21K 9/64 362/311.02 |
| 2015/0138775 | A1* | 5/2015 | Hata | F21K 9/64 362/293 |
| 2015/0308632 | A1* | 10/2015 | Ueno | F21K 9/30 362/235 |

FOREIGN PATENT DOCUMENTS

| | | | | |
|---|---|---|---|---|
| CN | 202927730 | U | 5/2013 | |
| CN | 203384709 | U | 1/2014 | |
| DE | 202011051605 | U1 | 1/2013 | |
| EP | 2392953 | A2 | 7/2011 | |
| EP | 2570717 | A1 | 3/2013 | |
| JP | 05190494 | A | 7/1993 | |
| JP | 03148965 | U | 3/2009 | |
| JP | 2011503786 | A | 1/2011 | |
| JP | 2012504310 | A | 2/2012 | |
| JP | 2012504786 | A | 2/2012 | |
| TW | 201144690 | A | 12/2011 | |
| WO | WO 2012132736 | A1 * | 10/2012 | F21K 9/1355 |
| WO | WO 2013027148 | A1 * | 2/2013 | G02B 6/0008 |
| WO | WO2013027148 | A1 | 2/2013 | |

OTHER PUBLICATIONS

Virtual Flamem LED Candle, http://unicornvt.com/portfolio/amazing-virtual-flame-candle/, Dec. 2013 (1 PAGE).
Virtual Flame LED Candles, http://www.youtube.com/watch?v=HF251R7A77Y; http://www.maxful.com/3-1%20(virtual%20flame%20candle).htm (Dec. 2013) (3 PAGES).

* cited by examiner

LIGHTING DEVICE COMPRISING A RING-SHAPED LIGHT TRANSMITTING ELEMENT

CROSS-REFERENCE TO PRIOR APPLICATIONS

This application is the U.S. National Phase application under 35 U.S.C. §371 of International Application No. PCT/EP2015/054646, filed on Mar. 5, 2015, which claims the benefit of European Patent Application No. 14160398.5, filed on Mar. 18, 2014. These applications are hereby incorporated by reference herein.

FIELD OF THE INVENTION

The present invention generally relates to the field of lighting devices comprising a light emitting element emitting light into a light transmitting element defining a hollow, and in particular lighting devices for simulating a candle flame.

BACKGROUND OF THE INVENTION

Lighting devices having a candle like appearance are of interest for various lighting purposes, including applications such as electric candle lamps. For such purposes, lighting devices capable of emitting light both sideways and upwards, as well as having an aesthetical appearance, are of particular interest.

In one example, a candle bulb having a glass envelope shaped to resemble a candle flame is provided. In another example, a remote phosphor element is arranged above a light emitting diode (LED) and is shaped so as to look like a flame.

In CN 102261568, a lighting device is disclosed in which an elongated optical element is employed to simulate a candle light. The optical element is arranged to receive and guide light emitted from a top emitting LED. The guided light is reflected within an enclosure defined by a surrounding envelope. The envelope is arranged so as to provide an elongated distribution of light which resembles a candle light that appears to be located within the enclosure.

US2012/0169235A1 discloses a light assembly including a light source circuit board and a plurality of light emitting diodes disposed on the light source circuit board. A plurality of light pipes axially extends from and adjacent to each light emitting diode. Each light pipe has a respective first end adjacent to the plurality of light emitting diodes and a second end opposite to the light emitting diodes. The plurality of light pipes communicates light from the light emitting diodes therethrough and defines a cavity therebetween.

Although such lighting devices may have a visual appearance and provide illumination suitable for e.g. candle lamps, there is still a need for new lighting devices being more compact.

SUMMARY OF THE INVENTION

In view of the above, a concern of the present invention is to provide a lighting device capable of generating light and which, during operation, has an appearance that resembles a candle light source. A further concern of the present invention is to provide a lighting device which is more compact and yet able to emit light in a wider range of directions.

This is achieved by a lighting device and a method having the features defined in the independent claims. Preferable embodiments are defined in the dependent claims.

Hence, according to a first aspect, a lighting device is provided which comprises a light transmitting element having a light in-coupling surface and a light out-coupling surface. The light transmitting element is arranged along a perimeter and having an inner sidewall, an outer sidewall and a top surface such that the light transmitting element defines a hollow. Further, the light in-coupling surface is adapted to couple light emitted by at least one light emitting element into the light transmitting element, wherein the light out-coupling surface is adapted to couple light out of the light transmitting element. A partially light reflecting envelope at least partially encloses the light transmitting element and is arranged to create a reflected image of the light coupled out of the light transmitting element The lighting device may also comprise a luminescent material for converting light emitted by the at least one light emitting element.

The invention makes use of an understanding that a light transmitting element can be arranged to influence the cross section or the shape of the distribution of light emitted by a lighting device. By arranging the light transmitting element along a perimeter such that a hollow is formed, the lighting device is capable of emitting light along a closed path surrounding a two-dimensional shape. The inner wall of the light transmitting element extends along one side of the perimeter and defines the hollow, and the outer wall of the light transmitting element extends along an opposite side of the perimeter, or, in other words, the light transmitting element extends on both sides of the perimeter. In other words, light can be guided from a light emitting element and emitted from a surface having a broad variety of shapes that may be reflected in the distribution of the light emitted from the lighting device. The light may e.g. be emitted from a circular, oval or polygonal shape, such that the cross section or shape of the light distribution may conform to the circular, oval or polygonal shape. Further, the light out-coupling surface may be formed so as to emit light in several directions.

The luminescent material, which is a material adapted to receive (absorb) light of a first wavelength and to emit light of a second wavelength, allows for a color conversion of the light emitted by the at least one light emitting element. The luminescent material, which additionally may be light diffusing or scattering, may e.g. be included in the light transmitting element, provided on a portion of the light in-coupling surface, a portion of the light out-coupling surface, and/or on the at least one light emitting element. The luminescent material may e.g. be provided on the light out-coupling and/or light in-coupling surface by a surface coating process such as lamination, spray coating or dip coating. The luminescent coating may completely or selectively cover the surface of the light transmitting element. By arranging the luminescent material on, or adjacent to, the light out-coupling surface, the amount of color converted light absorbed within the light transmitting element may advantageously be reduced and the color conversion efficiency hence increased.

By including the luminescent material in the light transmitting element, such as distributing the luminescent material in a bulk material, a more compact and more efficient lighting device may be provided without the need of separate light guiding means or color converting elements. This allows for a reduced cost, and the released space may advantageously be used for receiving a heatsink or an electrical means. The luminescent material may e.g. be relatively uniformly distributed in the light transmitting element so as to improve the spreading of light and/or color conversion within the light transmitting element, and to reduce the risk of glare. The distribution of luminescent material may also be varied in different portions of the light transmitting element for providing a heterogeneously distributed emission and/or color conversion of light emitted from the light transmitting element. Combining the light transmitting element with the luminescent material allows for the light to be both color conversed and guided by the same element.

It will also be realized that a luminescent material may be provided between a light emitting element and the light transmitting element. Further, different types of luminescent materials may be combined depending on the desired color of light to be emitted from the lighting device. Different colors may also be achieved by using different types of light emitting elements, such as e.g. blue and red LEDs.

The light transmitting element may e.g. be transparent or translucent, and may advantageously be adapted to diffuse the light so as to provide a uniform distribution of light emitted from the lighting device.

The light emitting element may comprise a light emitting surface extending along the perimeter, or at least along a portion of the perimeter. An example of such light emitting element may e.g. include a ring shaped organic light emitting diode (OLED). Alternatively, or additionally, the lighting device may comprise a plurality of light emitting elements arranged along the perimeter. In one example, the LEDs may comprise a dome-shaped cover.

The hollow may be adapted to receive a heat conducting material for improving heat dissipation, or a reflective material for improving the light emitting efficiency. Providing the heat conducting material within the light transmitting element, instead of outside the same, is advantageous in that a more compact lighting device is obtained.

Further, the present invention is advantageous in that the shape of the light out-coupling surface, which e.g. may conform to a ring or toroid, may be reflected at an inner surface of an at least partially light reflecting envelope arranged to at least partially enclose the lighting device. The reflected image of the light out-coupling surface may appear to be located within the enclosure defined by the envelope, and may, as a consequence of the shape of the envelope, be more or less distorted. As an example, an envelope formed as a glass bulb having a tapering, cylindrical shape may provide a reflected image which resembles a candle flame, i.e. an image having a relatively wide base and an upwards tapering contour. The hollow defined by the light transmitting element may be reflected in an interior of the simulated flame, thus providing a simulated flame having a relatively dark inner region enclosed by a relatively bright contour. Further, additional light emitting elements and/or light transmitting elements may be arranged within the hollow, e.g. along an additional perimeter. The additional light emitting elements may emit light of different colors. Light emitted by the additional light emitting elements may e.g. be reflected in the interior of the simulated flame, thereby improving the visual appearance of the simulated flame. The invention according to the present aspect is advantageous in that the distribution of light output by the lighting device may correspond to a simulated flame whose shape, color and intensity can be adjusted by means of e.g. the shape of the perimeter, the color of the emitted light, as well as the dimensions, light diffusing and color conversion abilities of the light transmitting element.

According to an embodiment, the hollow may be formed as a through-hole with a depth extending from the light in-coupling surface to the light out-coupling surface. The light transmitting element may e.g. conform to a surface of a genus, such as e.g. a toroid, a ring, a circle, an oval or a polygon, wherein the hole can be used to receive electrical means, such as a supply unit and a control unit for power supply or for control of the operation of the light emitting elements. Additional light emitting elements may also be arranged within the through-hole. Arranging the electrical means and/or additional light emitting elements within the through-hole of the light transmitting element provides for a more compact lighting device. Further, heat conducting elements, such as e.g. a heatsink, may be arranged within the hollow and brought in direct thermal contact with an underlying substrate so as to improve heat dissipation from the lighting device.

The light out-coupling surface may be oriented in several directions so as to provide multi-directional emission of light. The light out-coupling surface may e.g. comprise a first surface portion extending in a vertical direction parallel to the depth of the hollow and a second surface portion extending in a lateral direction. By varying the relation between the vertical extension of the light transmitting element, also referred to as its height, and the lateral width of the light transmitting element, the ratio between the height of first surface portion and the width of the second surface portion, and hence the ratio between the total areas of the surface portions, may be varied. The larger ratio between the area of the first surface portion and the area of the second surface portion of a light transmitting element, the more light may be emitted in the lateral direction compared to the vertical direction and vice versa. A lighting device wherein substantially all light is emitted through a laterally oriented surface may also be referred to as a top emitting lighting device, wherein a lighting device in which substantially all light is emitted through a vertically oriented surface may be referred to as a side-emitting lighting device. If light is emitted from a surface being oriented in two or more directions, the lighting device may be referred to as a multi-directional lighting device.

According to an embodiment, the light transmitting element may be formed such that, at a position along the perimeter, it has a lateral width that is larger than its height as measured along the depth of the hollow. As a result, a lighting device with an essentially top-emitting character is provided.

According to an embodiment, the lateral width of the light transmitting element at a position along the perimeter is smaller than its height at the same position. As a result, a lighting device with an essentially side-emitting character is provided.

According to an embodiment, a portion of the light out-coupling surface includes an at least partly light reflecting material, which advantageously allows for an adjustment of the direction and/or intensity of the light emitted by the lighting device. The at least partly light reflecting material may e.g. be arranged on lateral surface portions, i.e. the top surface of the light transmitting element, so as to increase the amount of side emitted light. Alternatively, or additionally, the at least partly light reflecting material may be provided on vertically oriented portions, i.e. the inner and/or outer sidewalls of the light transmitting element to increase the amount of top emitted light. The top- and/or side-emitting character of the lighting device may be varied depending on the coverage ratio of the light reflecting material. A top emitting lighting device may e.g. be achieved by fully covering the sidewalls with a light reflecting material adapted to reflect all, or at least most of, the light impinging thereon. Similarly, a side emitting lighting device may be obtained by covering the top surface such that all, or at least most of, the light impinging on the covering material is reflected back into the light transmitting element.

Providing the at least partly light reflecting material on the portions of the light out-coupling surface that defines the hollow, i.e. the inner sidewalls of the light transmitting element, may reduce the amount of light being out-coupled into the hollow. As a result, the light emitting efficiency of the lighting device may be increased. This may be particularly advantageous for side emitting lighting devices, since the light transmitted by the light transmitting element can be out-coupled without passing through the inner sidewalls defining the hollow.

The at least partly light reflecting material may e.g. be formed of diffusively reflecting material, such as a white backscattering material, or specularly reflecting material such as e.g. a metal. Further, the material may be provided in the form of a coating, a body or a foil. An additional at least partly light reflective or at least partly light absorbing layer may be added in order to further reduce the amount of light being out-coupled from the underlying surface of the light transmitting element.

According to an embodiment, the hollow is at least partly filled with an at least partly light reflecting material and/or a heat conducting material. The heat conducting material may act as a heatsink and facilitate dissipation of heat generated by e.g. the light emitting elements. A material that is both heat conducting and at least partly light reflecting advantageously reduces the need for additional or separate cooling means and additional or separate light reflecting means. Further, arranging the heat conducting material such that it at least partly fills the hollow allows for an efficient heat sink, since it is arranged adjacent to the heat sources. It also allows for a relatively more compact lighting device, since the heat sink (and possibly also the light reflecting material) is arranged within the light transmitting element.

According to an embodiment, the light transmitting element comprises a light diffusing material. The light transmitting element may e.g. be formed of a light diffusing material, or at least comprise portions that include such a material. As an alternative to this embodiment, the light diffusing material may also be provided on the light in-coupling surface and/or the light out-coupling surface of the light transmitting element. The material may e.g. be formed of a coating that partly or fully covers the surface portions of the light transmitting element. The light diffusing material may advantageously improve the uniformity as well as the angular spread of light emitted by the plurality of light emitting elements, thereby resulting in a relatively more uniform light emission from the lighting device.

According to an embodiment, the light in-coupling surface may about the at least one light emitting element, thereby providing a thermal contact between the light transmitting element and the at least one light emitting element. Heat dissipation or cooling capacity may therefore be improved, which is beneficial to the efficiency of the lighting device. The light transmitting element may e.g. be molded directly on the at least one light emitting element or a substrate to which the at least one light emitting element may be attached, thereby resulting in the at least one light emitting element being embedded in the light transmitting element. This advantageously allows for a reduced risk for leakage of light, i.e. light that is emitted without being received by the light transmitting element.

According to an embodiment, the light in-coupling surface may be arranged spaced apart from the at least one light emitting element. The light transmitting element may e.g. be pre-fabricated, or pre-molded, and arranged over the at least one light emitting element by e.g. bonding or gluing, or attached by clamping or clicking. The light transmitting element may e.g. be arranged on a spacer maintaining the distance between the light in-coupling surface and the at least one light emitting element. The spacer may also prevent light emitted by the at least one light emitting element from exiting the lighting device without passing through the light transmitting element, thereby reducing the risk for light leakage. The spacer may also facilitate mounting of the light transmitting element.

According to an embodiment, the at least one light emitting element is arranged on a substrate, wherein an outer sidewall of the light transmitting element is arranged to coincide with an edge of the substrate. As a result, the emitted light, and in particular the side-emitted light directed downwards, may not be obstructed by the substrate. The emission angle, and thus the spreading of the emitted light, may hence be increased.

According to an embodiment, the lighting device further comprises a partially light reflecting envelope arranged to at least partially enclose the light transmitting element. Further, the envelope may be adapted to reflect, at an inner surface portion of the envelope, at least some of the light out-coupled from the light transmitting element. As a result, a reflected image of the light transmitting element may be achieved within the enclosure defined by the envelope. The reflectivity can be varied so as to vary the ratio between the amount of light that is emitted to illuminate the surroundings and the amount of light that is observed as the simulated flame. The amount of light reflected by the inner surface of the envelope may e.g. be increased by increasing the refractive index of the envelope or by providing at least a portion of the envelope with a partially light reflective layer, such as a relatively thin, transflecting metal film or interference filters comprising e.g. dichroic coatings. The top portion of the envelope, i.e. the portion arranged further away from the light transmitting element in a lateral direction, may e.g. be more reflective than portions of the envelope arranged closer to the light source. This advantageously allows for a reflected image being relatively bright close to the top portion, whereas the loss of side-emitted light emitted to the surroundings through the portions of the envelope close to the light transmitting element may be reduced due to the relatively low reflectivity. The envelope may e.g. be formed as a cone or tapered cylinder, and e.g. comprise a polymer or glass.

The embodiment is advantageous in that the visual appearance of the reflected image can be adjusted in terms of e.g. shape, color, intensity and brightness so as to e.g. resemble the appearance of a candle flame. This can be achieved by e.g. varying the ratio between the side- and top-emitting character, the arrangement of a light diffusing material and/or a luminescent material, and varying the shape of the perimeter. The adjustment of the appearance of the simulated flame will be described in more detail with reference to the appended drawings.

According to an embodiment, one or several of the plurality of light emitting elements is/are controllable to adjust an amount of emitted light. The simulated candle flame may appear to flicker or wave back and forth by e.g. pulsing individual light emitting elements in sequence, or varying the amount of generated light over time. As a result, the simulated flame may appear to be more natural.

The term "light emitting element" may refer to any element that is capable of emitting radiation in any region or combination of regions of the electromagnetic spectrum, for example the visible region, the infrared region, and/or the ultraviolet region, when activated e.g. by applying a potential difference across it or passing a current through it. A light emitting element can therefore have monochromatic, quasi-monochromatic, polychromatic or broadband spectral emission characteristics. Each light emitting element has at least one light source. Examples of light sources include solid state emitters, such as laser diodes and semiconductor light emitting diodes (LEDs), organic, or polymer/polymeric LEDs, blue LEDs, optically pumped phosphor coated LEDs, optically pumped nano-crystal LEDs or any other similar devices. Alternatively, or additionally, the at least one light emitting element may comprise a LED that is capable of communicating with an external data source. Thereby the operation, such as e.g. the light intensity of the LED, may be controlled. The communication may e.g. be realized by means of an electrical or wireless data link.

It is noted that embodiments of the invention relate to all possible combinations of features recited in the claims. Further, it will be appreciated that the various embodiments described for the lighting device are all combinable with the embodiments described for the method as defined in accordance with the second aspect.

BRIEF DESCRIPTION OF THE DRAWINGS

This and other aspects will now be described in more detail with reference to the appended drawing(s) showing embodiment(s).

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION

The present aspects will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

Figure 1A:
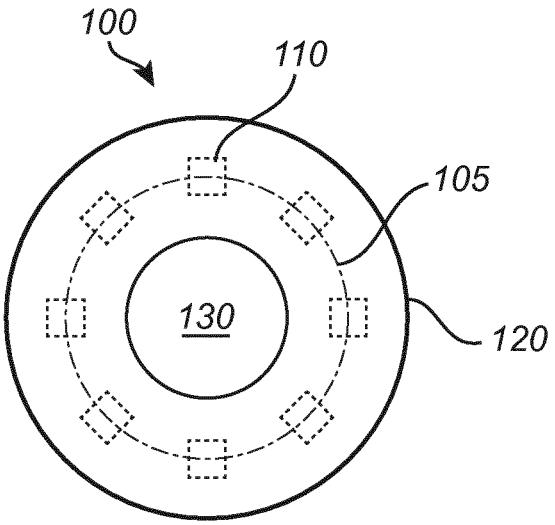
FIG. 1*a* is a top view of a lighting device according to an embodiment.
Figure 1B:
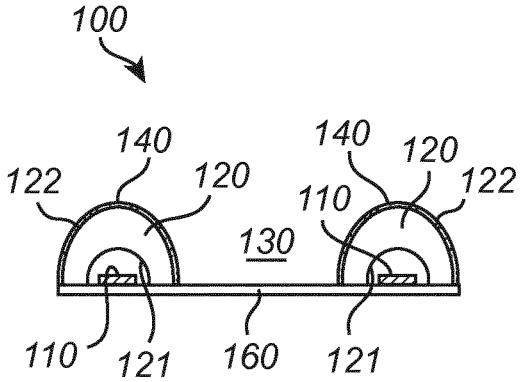
FIG. 1*b* is a cross sectional side view of the lighting device in FIG. 1*a*.
Figure 1C:
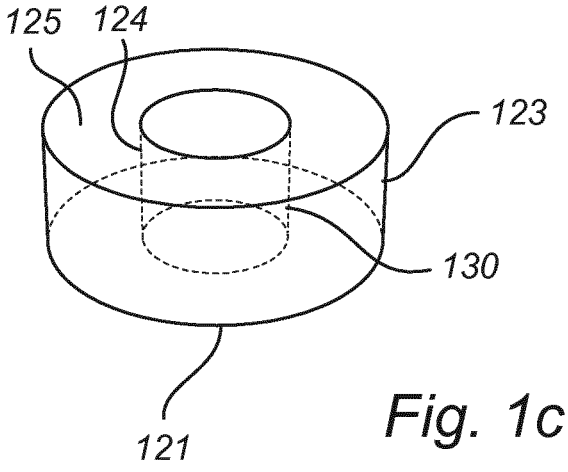
FIG. 1*c* is a perspective view illustrating the shape of a light transmitting element according to an embodiment.

A lighting device according to an embodiment will be described with reference to FIGS. 1*a-c*. The lighting device 100 comprises a light transmitting element 120 which is arranged along a perimeter 105 to define a hollow 130. The light transmitting element 120 is thus arranged along both sides of the perimeter 105. For example, an inside of the light transmitting element 120 defines the hollow 130 and is arranged along one side of the perimeter 105, and an outside of the light transmitting element 120 is arranged along another, opposite, side of the perimeter 105. The light transmitting element 120 may e.g. comprise a transparent material, a translucent material, or a light diffusing material, and may further be a phosphor comprising luminescent particles embedded in a matrix of e.g. silicone. The lighting device 100 may further comprise a plurality of light emitting elements 110, such as e.g. LEDs, arranged along the perimeter 105. In FIG. 1*a*, the perimeter 105 is indicated by a dashed line and conforms to the shape of a circle. As illustrated by the cross section of the lighting device shown in FIG. 1*b*, the LEDs 110 may be arranged on a substrate 160, such as e.g. a printed circuit board (PCB) to allow electrical contacting of the LEDs. The light transmitting element 120 is arranged such that light emitted by the LEDs 110 is received by the light transmitting element 120 via a light in-coupling surface 121, and output via a light out-coupling surface 122 of the light transmitting element 120. Further, a light diffusing material 140 may be provided on the light out-coupling surface 122 in order to increase the homogeneity of the light emitted from the lighting device 100. The LEDs 110 and/or the light transmitting element 120 may e.g. be surface mounted to the substrate 160. FIG. 1*c* is a perspective view of a similar light transmitting element 120 as described with reference to FIGS. 1*a* and 1*b*. As illustrated in FIG. 1*c*, the light transmitting element 120 may have a toroid shape comprising a through-hole 130 with a depth that extends from the light in-coupling surface 121 to a lateral top portion 125 of the light out-coupling surface, which also may comprise vertical sidewall portions 123, 124. In this embodiment the inner vertical sidewall portion 124 of the light transmitting element 120 defines the hollow 130 and is arranged along one side of the perimeter, and the outer vertical sidewall portions 123 of the light transmitting element 120 is arranged along another, opposite, side of the perimeter.

During operation, light emitted by the LEDs 110, such as e.g. blue or UV-light, may be received by the light transmitting element 120 via the light in-coupling surface 121, transmitted and partially converted by the light transmitting element 120 into another wavelength range resulting in a white color, emitted via the light out-coupling surface 122 and diffused by the diffuser 140. As a result, a relatively compact lighting device 100 according to the embodiment described with reference to FIGS. 1*a-c* may provide a relatively more uniform and relatively omni-directional illumination which appears to be generated from a ring shaped, three-dimensional light source defined by the light out-coupling surface 122 of the light transmitting element 120.

Lighting devices according to other embodiments will be described with reference to FIGS. 2*a* and *b*. The lighting device 200 shown in FIG. 2*a* may be similarly configured as the lighting device 100 described with reference to FIGS. 1*a-c*, but according to the embodiment of FIG. 2*a*, a light reflecting material 180 may be provided on portions of the light out-coupling surface 122.

Figure 2A:
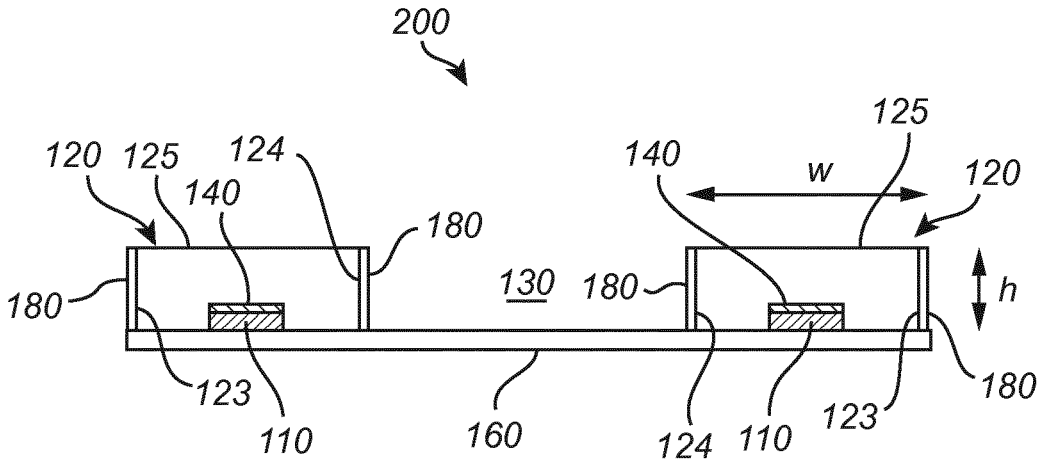
FIGS. 2*a* and *b* are cross sectional side views of lighting devices according to embodiments.

In FIG. 2*a*, the light transmitting element 120, such as e.g. a phosphor, may have a lateral width w of the lateral top surface portion 125 that is larger than the height h of the vertical sidewall portion 123 as measured in a direction parallel to the extension of the depth of the through-hole 130. Further, the light reflecting material 180 may be applied to the vertical surface portions 123, 124 of the light out-coupling surface 122, i.e. to the surface portions parallel to the extension of the depth of the through-hole 130. As a result, light may be emitted mainly from the lateral surface portions 125, also referred to as the top surface, thereby making the lighting device 200 a top emitter. Further, a light diffusing material 140 may be provided between the LEDs 110 and the light transmitting element 120 so as to increase the uniformity of the light distribution. Light emitted by the LEDs 110 may therefore diffuse at the diffusing material 140, propagate through the light transmitting element 120, and exit through the top surface 125. In fact, light of a first wavelength emitted by the LEDs is partially absorbed in the phosphor 120 and secondary photons are emitted at another wavelength by the phosphor 120. Light impinging on the reflective coating 180 at the vertical side portions 123 of the phosphor 120 may be reflected back into the phosphor 120.

Figure 2B:
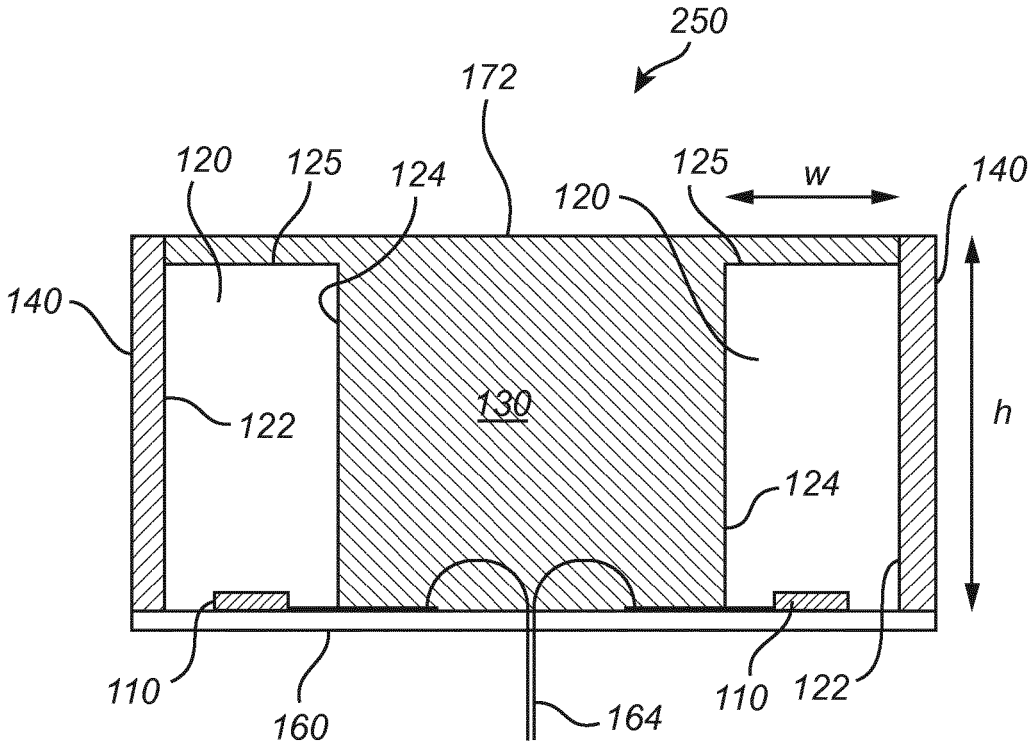

FIG. 2*b* illustrates a lighting device 250 similarly configured as the lighting device 200 described with reference to FIG. 2*a*. As shown in FIG. 2*b*, the light transmitting element 120 may have an average lateral width w of the lateral top surface portion 125 that is smaller than an average height h of the vertical sidewall portion 123. In other words, the area of the lateral top surface 125 is relatively small compared to the area of the vertical sidewall portion 123. Further, a light reflecting and heat conducting material may be provided on the top surface 125 of the light transmitting element 120 so as to reflect top-emitted light back into the light transmitting element 120. As a result, a side-emitting lighting device may be obtained. The hollow 130, in this embodiment formed as a through-hole, may be filled with a heat conducting and light reflecting material 172 which thereby acts as a light reflecting heat sink. The heat generated by the LEDs 110 may then be dissipated by means of the heat sink. If the through-hole 130 is filled with the heat conducting and light reflecting material 172, the light transmitted through the light transmitting element 120 towards the hollow 130 may be reflected back at the vertical surface portions 124 of the light out-coupling surface facing the through-hole 130. In one example, the through-hole may be filled with two different materials, such as a relatively light reflecting material, which may be provided on or adjacent to the light out-coupling surface, and a relatively heat conducting material which fills up the remaining part of the through-hole 130. The relatively light reflecting material may e.g. be a silver coating, and the relatively heat conducting material may e.g. comprise copper, aluminum or a polymer comprising e.g. thermally conductive particles. The through-hole 130 may also be filled with a ceramic material, such as light scattering alumina, which may be both light reflecting and heat conducting. The fill-up material may also be integrally formed with the substrate 160, which e.g. may be a ceramic substrate 160. In the present embodiment, the substrate 160 may include a through-hole 130 in which electrical conductors 164 may be guided into the hollow 130 of the light transmitting element 120 so as to supply the LEDs 110 with electrical power.

Figure 3:
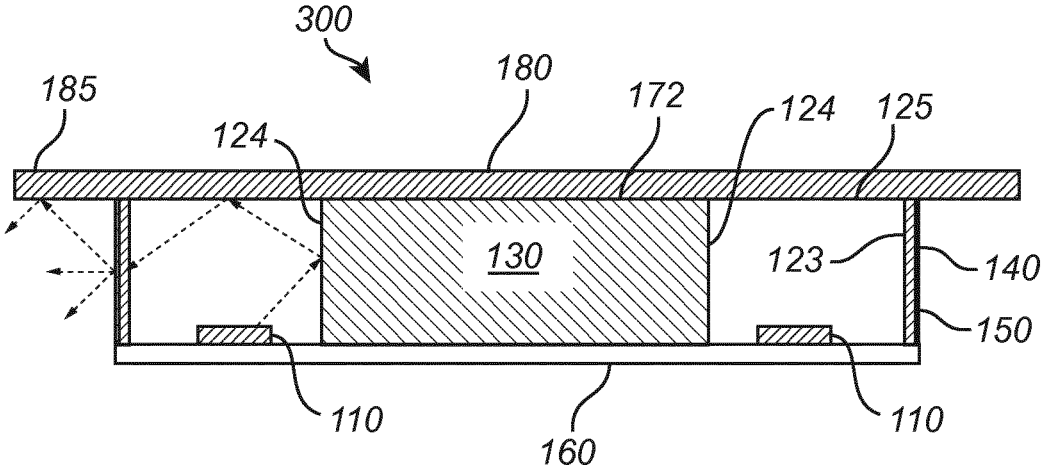
FIG. 3 is a cross sectional side view of a lighting device according to an embodiment, wherein a path of emitted light is illustrated.

FIG. 3 shows another embodiment, which may be similarly configured as the lighting devices 100, 200, 250 as described with reference to FIGS. 1*a-c* and 2*a* and 2*b*. The light emitting elements 110, such as LEDs, may be arranged to emit light into e.g. a toroid shaped light transmitting element 120. The through-hole 130 may be filled with a light reflecting material 172 arranged to reflect light back into the light transmitting element 120. The vertical, outer sidewalls 123 of the light transmitting element 120 may be optionally provided with a luminescent material 150 and/or a diffusing material 140. The diffusing material 140 and the luminescent material 150 may e.g. be provided as a thin coating layer. Further, a light reflecting or transflecting material 180, formed as a circular disc, may be arranged on top of the lighting device 300 such that it fully covers the lateral portions 125 of the light out-coupling surface of the light transmitting element 120. As illustrated in FIG. 3, the circular disc may have a diameter that is slightly larger than the corresponding diameter of the underlying light transmitting element 120 such that an overhang is provided by a peripheral portion of the disc. The overhang 185 may shadow the peripheral, vertical sidewall 123 of the light transmitting element 120 such that some of the light that is out-coupled through the vertical sidewall 123 may be reflected by the overhanging portion 185 of the disc.

The arrows of FIG. 3 represent a contemplated path of light emitted by one of the LEDs 110. The emitted light may be transmitted by the light transmitting element 120 towards the portion 124 of the light out-coupling surface defining the hollow 130. The light may then be reflected by the light reflecting material 172 in the hollow 130 and redirected back into the light transmitting element 120, wherein it is reflected by the reflecting disc 180 covering the lateral top portions 125 of the light transmitting element 120. Eventually, the light may exit the light transmitting element 120 through the outer, vertical sidewall 123, at which it is converted by the luminescent material 150 and diffused by the diffusing layer 140. In FIG. 3, the diffused light is illustrated by a plurality of arrows, or light rays. As indicated, some of the light, which exits the outer sidewall 123 in an upward direction, may impinge the overhanging part 185 of the reflecting disc 180 and hence may be reflected in a downward direction. As a result, the amount of light emitted in an upward direction may be reduced. It can also be noted that the outer, vertical sidewall 123 of the light transmitting element 120 may be arranged such that it coincides with an edge of the substrate 160 so as to reduce the risk for shadowing effects and obstructions of light, thereby increasing the amount of light emitted in downward directions.

Figure 4A:
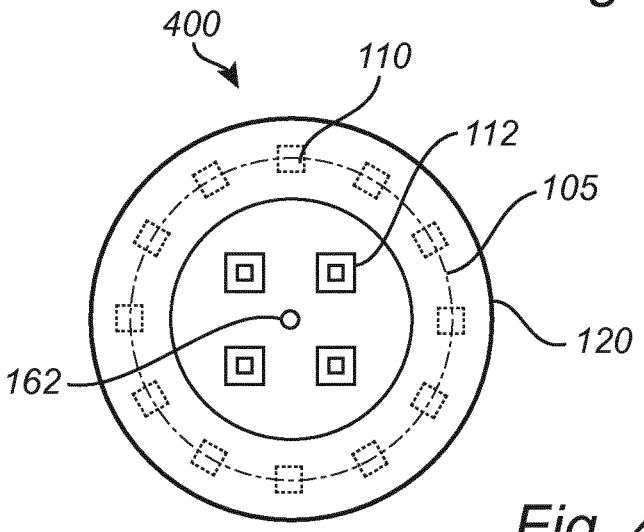
FIGS. 4*a* and *b* are top views of lighting devices according to other embodiments.
Figure 4B:
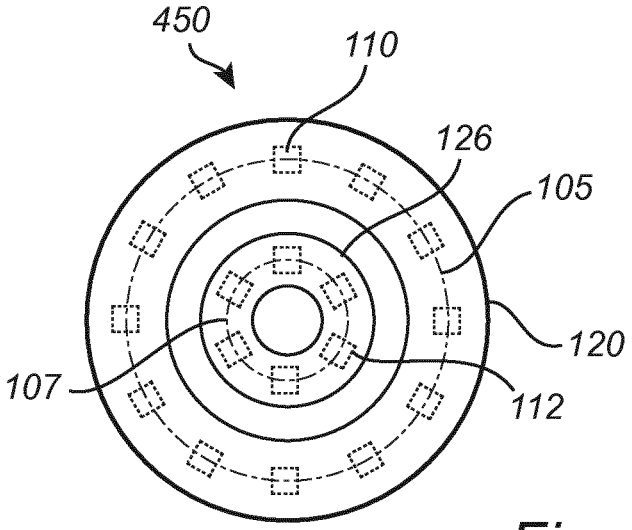

FIGS. 4*a* and 4*b* show lighting devices according to other embodiments. The lighting devices 400, 450 may be similarly configured as the lighting devices described with reference to any one of the previous figures, wherein at least one additional light source 112 may be arranged within the hollow 130 defined by the light transmitting element 120. According to the example shown in FIG. 4*a*, four additional light emitting elements 112 may be provided. The additional light emitting elements 112 may e.g. be LEDs arranged on a respective quad flat no-leads (QFN) package or plastic leaded chip carrier (PLCC), or other LED types such as e.g. dies-on-ceramic substrate or chip-scale LED packages. The light emitted by the LEDs 112 may e.g. be white, blue, red, or of any other suitable color.

As shown in FIG. 4*b*, additional light emitting elements 112 may be arranged along another perimeter 107. The another perimeter 107 may e.g. be concentrically arranged within the outer perimeter 105. Further, an additional light transmitting element 126, such as a light transmitting element, may be arranged along the another perimeter 107. In FIG. 4*b*, the outer light transmitting element 120 may emit light having a warm white color while the inner light transmitting element 126 emits a blue color. The colors may e.g. be generated by a luminescent material included in the light transmitting element(s) 120, 126, by a luminescent material provided on a surface of the light transmitting element(s) 120, 126, or by a luminescent material provided on a surface of the light emitting element(s) or a surface of the light emitting element(s) 110, 112.

Figure 5:
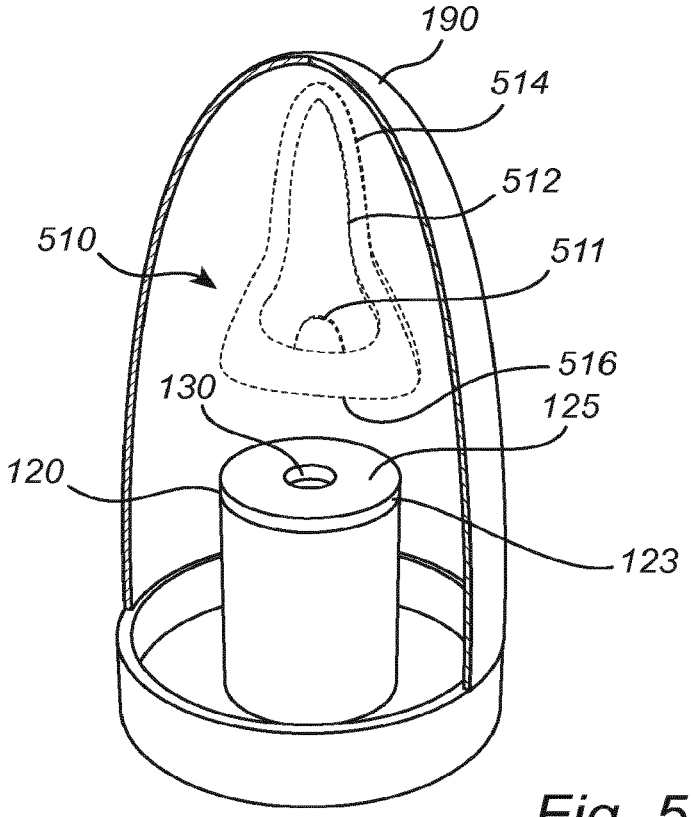
FIG. 5 is a perspective view of a lighting device according to a further embodiment, illustrating a simulated candle flame.

A lighting device 500 according to another embodiment will be described with reference to FIG. 5. The lighting device 500 may be similarly configured as any one of the lighting devices described with reference to any one of the previous figures. The lighting device 500 may further include a partially light reflecting envelope 190, such as e.g. a glass bulb, arranged to enclose the light transmitting element 120. As illustrated in the embodiment disclosed by FIG. 5, the light transmitting element 120 may form a toroid having a cylindrical inner through-hole 130 and may be arranged to emit more homogenously distributed light, thereby forming a relatively uniform, three dimensional light source defined by the light out-coupling surface 122.

Light emitted from the light source may be reflected at an inner surface of the glass bulb 190, thereby generating a reflected image 510 of the light source. Depending on the shape and orientation of the glass bulb 190, the reflected image 510 may be more or less distorted. As an example, a glass bulb 190 having a shape conforming to a tapering cylinder may reflect the light source such that the reflected image 510 resembles a candle flame, i.e. having a relatively wide base and a tapering upper portion. The simulated flame may be divided into different regions, or zones. In FIG. 5, four different regions may be identified based on the geometry of the light transmitting element 120. The four regions are: the inner region 511, representing the hollow 130 of the light transmitting element 110; the intermediate region 512, representing light predominantly emitted from the inner sidewalls defining the hollow 130; the peripheral region 514 representing light predominantly emitted from the top 125 of the light transmitting element 120, i.e. the lateral surface portions of the light out-coupling surface; and the base region 516, representing light predominantly emitted from the outer, lateral sidewalls 123 of the light transmitting element. Due to the tapering shape of the cylindrical glass bulb 190 depicted in FIG. 5, at least the peripheral region 514 is tapering towards its top, thus resembling the peripheral shape of a candle flame.

By varying the color and intensity of light emitted from the different surface portions 123, 124, 125 of the light transmitting element 120, e.g. from its top surface 125, outer sidewalls 123 and inner sidewalls 124, the color and/or intensity of the different regions 511, 512, 514, 516 of the flame 510 may be adjusted. In the following, various examples of configurations are described with reference to FIG. 5:

i) Outer sidewalls 123 and top surface 125 of the light transmitting element 120, but not the inner sidewalls 124, coated with a phosphor 150; blue LEDs 110. As a result, a flame 510 may be simulated which has a warm white appearing base region 516 and peripheral region 514, a bluish intermediate region 512 and a darkish inner region 511.

ii) Similar configuration as in i), but with the inner sidewalls 124 provided with a diffusively light reflecting material 180. A flame 510 may be simulated which has a warm white appearing base region 516 and peripheral region 514, and a darkish intermediate region 512 and inner region 510.

iii) Similar configuration as in i), but with diffuser foil 140 arranged to cover the top surface 125 and the hollow 130. The blue light leaking from the inner sidewalls 124 may be diffused and a flame 510 may be simulated which has a warm white appearing base region 516 and peripheral region 514, and a bluish intermediate region 512 and inner region 510.

iv) Similar configuration as in iii), but with the diffuser 140 replaced with a semi-transmitting and partly diffusively reflecting material. A relatively bright base region 516 may be generated, whereas the inner region 511, the intermediate region 512 and the peripheral 514 region have a relatively low visual intensity.

v) Similar configuration as in iv), but with a specularly reflecting metallic mirror 180 covering the top surface 125 and the hollow 130. Since most of the light may be emitted from the outer sidewalls 123 of the light transmitting element 110, the base region 516 of the simulated flame 510 may be relatively bright whereas the remaining regions 511, 512, 514 are darkish. Alternatively, the diameter of the metallic mirror 180 may be slightly smaller than the outer diameter of the ring-shaped light transmitting element 120 so as to expose a peripheral edge of the top surface 125. As a result, the base region 516 may be provided with a rim of light extending from the outer periphery of the base region 516 and brightly along the periphery 514 in a vertical direction such that a U-shaped virtual flame 510 may be achieved, which might resemble edge flames of a fire. Alternatively, or additionally, the metallic mirror 180 may be provided with holes extending through the reflecting material so as to enable a leakage of light. The holes, through which the light is leaking, may be represented as points of flame like shapes in the inner region 511 and/or intermediate region 512, thus enabling a more fire like appearance.

vi) Similar configuration as in ii), but with four additional LEDs (e.g. blue emitting) 112 arranged within the hollow 130, thereby enabling four local hot spots to appear in the inner region 516 of the simulated flame 510. This configuration allows driving different groups of LEDs independently, thereby changing the brightness and/or color ratio of different parts of the flame.

vii) Similar configuration as in vi), but with a top opening of the hollow 130 covered with a diffuser foil 140 diffusing the light emitted by the four additional blue LEDs 112. A flame 510 may be generated, in which the light from the four additional LEDs 112 may be relatively uniformly distributed in the inner region 511.

According to further examples, the additional LEDs 112 arranged within the hollow 130 may be adapted to emit red light so as to enable a simulated flame 510 having a reddish inner region 511 and/or intermediate region 512. The additional LEDs 112 may also emit cool-white light so as to enable a simulated flame 510 having a warm-white periphery 514 and a cool whither inner region 511 and/or intermediate region 512 or vice versa. Further, the outer sidewall 123 may be provided with a warm white phosphor 150 so as to enable a warm white base region 516, and/or the top surface 125 provided with a cool white phosphor 150 to enable a cool white peripheral region 514 of the simulated flame 510. The light transmitting element 120 may also comprise a red phosphor 150 or receive light emitted from red LEDs 110 so as to enable a simulated flame 510 having a reddish appearance. Further, additional LEDs 112 emitting warm white light may be provided inside the hollow 130 to enable a simulated flame 510 having a reddish base region 516 and/or peripheral region 514, and a warm-white intermediate region 512 and/or inner region 511.

Further, the lighting device 100 may be provided with additional light emitting elements 112 and/or additional light transmitting elements 126, such as e.g. a plurality of LEDs 112 arranged along one or several additional perimeter(s) 107 within the hollow 130, and one or several additional light transmitting element(s) 126 arranged along said additional perimeter(s) 107. It will also be realized that the diffusing and/or reflecting and/or luminescent material 140, 150, 180 may be provided with various shapes and patterns so as to enable simulated flames 510 of various visual appearances. As an example, a phosphor material may be selectively added to selected portions of the light out-coupling surface by e.g. printing.

As previously mentioned, the perimeter 105 may define a circle, an oval, or various types of polygons. Consequently, the light transmitting element 120 may have an extension conforming to said perimeter, hence forming a toroid or a toroidal polyhedron.

According to embodiments of the invention, one or several of the light emitting elements 110, 112 may be operated in a pulsed manner so as to enable a dynamic shifting, such as flickering, of the simulated flame 510. In one example, the additional LEDs 112 within the hollow 130 may be repeatedly turned on and off so as to generate a superimposed flicker of the intermediate region 512 and/or inner region 511 of the simulated flame 510. The duration of the respective on and off periods, as well as the rise and decay times and the frequency of the flickering LEDs 110, 112 may be adjusted to obtain a simulated flame 510 having an improved resemblance with e.g. a candle flame. In other examples, the plurality of light emitting elements 110 arranged along the perimeter may be randomly turned on and off, or sequentially operated in order to obtain a simulated flame 510 that appears to be waving back and forth. Also, by gradually switching on and off a plurality of light emitting elements along an outer perimeter, a plurality of light emitting elements along an intermediate perimeter and a plurality of light emitting elements along an inner perimeter, the flame may be perceived as growing and shrinking in size over time.

Figure 6:
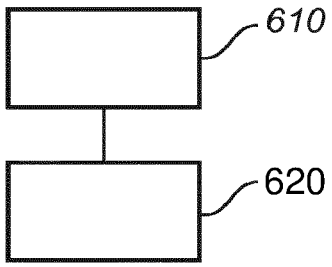
FIG. 6 is a schematic outline of a method according to an embodiment.

FIG. 6 is a schematic outline of a method, wherein a lighting device is obtained which is similarly configured as the lighting device according to any one of the previously described embodiments. The method comprises the steps of arranging 610 a light transmitting element 120 along a perimeter 105 such that the light transmitting element 120 defines a hollow 130, and arranging 620 a luminescent material such that it converts light emitted by the light emitting element.

The person skilled in the art realizes that the present invention by no means is limited to the preferred embodiments described above. On the contrary, many modifications and variations are possible within the scope of the appended claims. For example, a side emitting lighting device may be combined with reflectors into spot light fixtures. Since the lighting device according to the present invention is relatively small and compact, a smaller beam angle and/or lower reflector (i.e. the distance between the reflector bottom and the opening) may be used. Such fixtures may also provide a reduced glare due to the side emitting light source.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting device, comprising:

a light transmitting element extending along a perimeter and having an inner sidewall, an outer sidewall and a top surface such that said light transmitting element defines a cylindrical inner through-hole within said inner sidewall, said light transmitting element comprising:

a light in-coupling surface arranged between said inner sidewall and said outer sidewall, said light in-coupling surface configured to couple light emitted by at least one light emitting element, into the light transmitting element, the at least one light emitting element being arranged on the perimeter between said inner sidewall and said outer sidewall; and a light out-coupling surface, configured to couple light out of the light transmitting element, said cylindrical inner through-hole having a depth extending from said light in-coupling surface to the light out-coupling surface; and a partially light reflecting envelope at least partially enclosing the light transmitting element and arranged to create a reflected image of the light coupled out of the light transmitting element, wherein the envelope has a shape conforming to a tapering cylinder and the reflected image resembles a candle flame.

2. The lighting device according to claim 1, wherein the lighting device comprises a plurality of light emitting elements arranged along the perimeter or wherein the at least one light emitting element comprises a light emitting surface extending along said perimeter.

3. The lighting device according to claim 1, wherein the light transmitting element has a shape conforming to the shape of a toroid, a ring, a circle, an oval or a polygon.

4. The lighting device according to claim 1, wherein the candle flame has a relatively dark inner region enclosed by a relatively bright contour.

5. The lighting device according to claim 1, wherein the through hole is at least partly filled with an at least partly light reflecting material and/or heat conducting material.

6. The lighting device according to claim 1, wherein the light transmitting element comprises a light diffusing and/or luminescent material.

7. The lighting device according to claim 1, wherein at least one additional light emitting element and/or light transmitting element is arranged within the through hole.

8. The lighting device according to claim 1, wherein the light out-coupling surface comprises a portion of the top surface of the light transmitting element.

9. The lighting device according to claim 1, wherein the light out-coupling surface comprises a portion of the outer sidewall of the light transmitting element.

10. The lighting device according to claim 1, wherein the light out-coupling surface comprises a portion of the outer sidewall and a portion of the top surface of the light transmitting element.

11. The lighting device according to claim 1, wherein outer sidewalls and a top surface of the light transmitting element comprise a luminescent material.

12. The lighting device according to claim 11, wherein the inner sidewall is provided with a diffusively light reflecting material.

13. The lighting device according to claim 11, wherein a diffuser foil is arranged to cover the top surface and the through hole.

14. The lighting device according to claim 11, wherein a specularly reflecting metallic mirror is arranged to cover the top surface and the through hole.

15. A lighting device, comprising:

a light transmitting element extending along a perimeter and having an inner sidewall, an outer sidewall and a top surface such that said light transmitting element defines a hollow, said light transmitting element comprising:

a light in-coupling surface configured to couple light emitted by at least one light emitting element, into the light transmitting element, the at least one light emitting element being arranged on the perimeter; and a light out-coupling surface, configured to couple light out of the light transmitting element; and a partially light reflecting envelope at least partially enclosing the light transmitting element and arranged to create a reflected image of the light coupled out of the light transmitting element, wherein the envelope has a shape conforming to a tapering cylinder and the reflected image resembles a candle flame, said reflected image having, relative to said light transmitting element, a proximal end, a distal end, opposite said proximal end, and an inner region between said proximal end and said distal end, said proximal end having a first brightness, said distal end having a second brightness, and said inner region having a third brightness, wherein said third brightness is less than said first brightness and said second brightness.

* * * * *